US010631567B2

(12) United States Patent
Martel

(10) Patent No.: US 10,631,567 B2
(45) Date of Patent: Apr. 28, 2020

(54) DEVICE AND METHOD FOR FORMING SMOKABLE MATERIALS

(71) Applicant: Joel S. Martel, Brimfield, MA (US)

(72) Inventor: Joel S. Martel, Brimfield, MA (US)

( * ) Notice: Subject to any disclaimer, the term of this patent is extended or adjusted under 35 U.S.C. 154(b) by 194 days.

(21) Appl. No.: 15/625,733

(22) Filed: Jun. 16, 2017

(65) Prior Publication Data

US 2018/0360098 A1 Dec. 20, 2018

(51) Int. Cl.
*A24B 3/14* (2006.01)

(52) U.S. Cl.
CPC ..... *A24B 3/14* (2013.01)

(58) Field of Classification Search
CPC ..... A24B 3/14
USPC ..... 131/119
See application file for complete search history.

(56) References Cited

U.S. PATENT DOCUMENTS 1,370,116 A * 3/1921 Johnson ..... B21D 28/34 72/464
4,848,222 A * 7/1989 Fleissner ..... B30B 9/3078 100/35
6,164,287 A * 12/2000 White ..... A24F 47/008 131/194

OTHER PUBLICATIONS

"Stainless Steel Hash Press", Wacky Willys, 2019, 9 pages, [online], retrieved from the Internet, [retrieved May 24, 2019], . (Year: 2019 ).*
Internet Wayback Machine capture of "Stainless Steel Hash Press", Wacky Willys, Apr. 2016, 8 pages, [online], retrieved from the Internet, [retrieved May 24, 2019, . (Year: 2016).*

* cited by examiner

*Primary Examiner* — Dennis R Cordray
(74) *Attorney, Agent, or Firm* — Hubert W. Pfabe

(57) ABSTRACT

A device and method of forming smokable materials are disclosed. The device may include a puck, which may be configured to at least partially pass through a channel defined by a die from one end of the die. The die and the puck are configured such that smokable material may be placed within the die from that end and compressed by the puck against a substantially rigid surface proximal to the other end of the die. The puck may be pushed through the channel in the die using a feature that provides mechanical advantage. The puck and die may also be attached to or may be part of a press, such as a t-handle press. A spacer may also be included to maintain a minimum height of the compressed smokable material. The device is configured such that the compressed smokable material may be inserted into the oven of a vaporizer.

19 Claims, 11 Drawing Sheets

DEVICE AND METHOD FOR FORMING SMOKABLE MATERIALS

BACKGROUND

The present disclosure relates generally to a device and method for forming smokable materials. More particularly, the present disclosure relates to forming smokable materials into substantially compressed packets which are configured so as to be compatible with vaporizer devices.

Various types of vaporizers are known in the art. Vaporizers are used to create a vapor which is typically intended to be inhaled by a user. The vapor may be formed from heating a variety of substances, including liquids, powders, leaf, leaves, leaf-like materials, ground or partially ground plant matter, and other substances and combinations of materials and substances. A wide range of substances may be completely or partially converted to vapor, including tobacco or nicotine. A vaporizer typically uses a heating element, also known as an atomizer, to heat material. The material may be in a cartridge or other closed volume, which may be replaceable, or may be inserted into a chamber known as an oven. Many users of vaporizers prefer to load their vaporizer oven themselves, using their preferred smokable material.

Current devices and methods for loading a vaporizer oven are inconvenient and either risk spilling material or require carrying additional equipment to where one may wish to load the vaporizer. Users of vaporizers often manually load the vaporizer with smoking materials which are carried in a separate container, such as a pouch or rigid container. The oven of the vaporizer is exposed and material may be loaded manually, potentially spilling. A funnel may be used to load a vaporizer oven, though this constitutes an additional piece of equipment which must be carried by a user.

Many users of vaporizers prefer to have the smokable material in the oven compressed so as to provide a more enjoyable user experience, often including a higher content of desirable substances in each inhalation of vapor, including flavor and/or nicotine. Compressed smokable materials also tend to provide more inhalations of vapor per loaded oven than non-compressed materials. Compressing material within a vaporizer oven requires another additional tool, such as a tamp or other packing tool. Such tools often do not satisfactorily compress the smokable material, as they are pushed in by hand, or even by a single finger, and provide no mechanical advantage. Additionally, such packing tools press down smokable materials within the vaporizer oven, often creating a complete compressed layer along the entire bottom of the oven. This may prevent air flow and offers no sideways room for expansion of the smokable material as it heats up. Some vaporizers heat the material by means of electrical conduction, though others need to pass heated air by or through the material. Current means of compressing smokable material within a vaporizer oven also tend to leave residue on the sides and bottom of the oven, which may make the oven difficult to clean.

SUMMARY

The disclosure relates generally to a device and method for forming smokable materials. More particularly, the present disclosure relates to forming smokable materials into substantially compressed packets which are configured so as to be compatible with vaporizer devices. The disclosure also relates to a kit of parts which may be used to perform the disclosed method or to assemble the disclosed device.

In one embodiment, the present invention includes a puck which may be used for compressing the smokable material. The puck may have a footprint which is substantially circular, oval, rectangular, have one or more curved sides, one or more linear sides, or may have any other shape which may be desirable by a user so as to conform to the shape of an oven of a vaporizer. The puck may be made of plastic, such as delrin, metal, such as aluminum or stainless steel, or any other material and be of any thickness so as to have sufficient rigidity. It may be preferable to use a material which is easily cleanable and may be washed.

The device may also include a die which includes at least one channel passing substantially through the length of the die. The die may include an opening at one end to allow insertion of smokable material into the die and into the channel. The other end of the die may not include a second opening, creating only a partial channel through part of the die, with the closed end of the die being a surface against which smokable material may be compressed. In such an embodiment, the compressed smokable material could be removed through the same opening through which it was inserted prior to being compressed. In a preferred embodiment, the other end of the die may include a second opening, allowing smokable material to pass through the channel and come out through the opening on the other end as it is compressed or after it has been compressed. This may allow for easier removal of compressed smokable material as well as cleaning.

The channel in the die may be configured so as to substantially conform to the footprint of the puck, so that the puck may maintain alignment as it is pushed at least partially into the channel. The channel and puck may also be configured such that smokable material is substantially impeded from passing in between the sides of the puck and the interior sides of the channel of the die as the puck is pushed within the channel. In a preferred embodiment, the puck and channel within the die are configured such that the footprint of the smokable material, after it is compressed by the puck, is configured to fit within the oven of a vaporizer. Compressed smokable material may allow for a larger number of puffs of vapor or inhalations per loaded oven of a vaporizer. Compressed smokable material may also allow for stronger flavor or higher amounts of a desired vaporized substance, such as nicotine.

The puck and the die, and the device itself, may be configured such that the footprint and the volume of the compressed smokable material are smaller than the respective footprint and volume of the oven of the vaporizer. This may allow for the compressed smokable material to be smoked or vaporized within the vaporizer while minimizing the residue left on the inside of the oven and minimizing the cleaning requirements of the vaporizer. This may also allow for air flow around the compressed smokable material within the oven of the vaporizer. It may also allow for the compressed smokable material to expand when heated within the oven of the vaporizer, and may allow for air flow around or through the expanded compressed smokable material. In one embodiment, the compressed smokable material may have a smaller footprint or volume than the oven of the vaporizer such that a gap may be present between one or more sides of the compressed smokable material and one or more inside surfaces of the oven. In one embodiment, the gap may be between 0.1" and 0.2", though the puck and die may be configured such that other sizes of gaps, both smaller and larger, may also be created.

The puck may be pushed into or through the die by means of a translating element, such as a rod. The puck may be separate from the translating element, may be removably attached to it, may be fixed to it, may be unitary with it, or may be rotatably connected to it. The rod, and the overall device, may provide mechanical advantage to the translation of the puck. The mechanical advantage may be created by a lever arm, by threading, such as threading of the rod, or through other means known in the art. In one embodiment, the rod is threaded such that it and/or the puck translates through the die as it is being rotated. The rod may be threaded directly or indirectly to the die. The rod may be threaded through another feature or component of the device, such as a top cap which may be attached to the die or may be attached to a body component which at least partially surrounds or otherwise at least partially contains the die.

The device may be a press which includes one or both of the puck and die either as separate components or as integral features of the press. The press may have one or more die and one or more pucks, allowing for creation of one packet of compressed smokable material at a time or allowing for the creation of multiple packets of compressed smokable material simultaneously.

The device may be a t-handle press. Such a press, also known as a T Pollen Press or a T Press, may include a t-handle with a threaded rod. It may include a main body which may be substantially cylindrical and define a through channel with an end at either opening. The t-handle press may include a top cap which may be attached to the top of the main body, such as by threading of the top cap onto the main body. The top cap may have an opening which may also be threaded. The t-handle and associated threaded rod may thread through the top cap, thus translating through the top cap and into the main body. The t-handle press may include a bottom cap. The bottom cap may attach to the main body, such as by threading. The bottom cap may include a bottom surface. The bottom surface may be substantially planar. The bottom surface may be substantially without openings, may be solid, or may include one or more openings, such as for pressing moisture out of material which is being compressed by the t-handle press. The bottom cap may include a central opening, which may be any desired shape and size, including circular, rectangular, and oval. The central opening may be small compared to the footprint of the bottom cap, medium sized, or may be relatively large. In one embodiment, the central opening in the bottom cap is diamond-shaped and is sized and shaped so as to permit removal of compressed smokable material while resisting the die being pushed out of the bottom of the bottom cap. The bottom cap may be made of any material or have any thickness which provides sufficient rigidity while compressing the smokable material.

In one method of use, smokable material may be inserted into the die which may be substantially within the main body of the t-handle press, or may be inserted into the main body of the t-handle press after smokable material is inserted into the die. The die may be a separate component which may be removed from the main body, it may be connected to the main body or device, or it may be unitary with the device or the main body. The die may include at least one chamfered surface at the opening where smokable material is inserted, thus making it easier for the user to insert smokable material and minimizing spilling of smokable material. The top cap may be attached to the main body. The t-handle may then be threaded into the top cap, or the t-handle may already be threaded onto the top cap. The puck may be inserted into the opening in the die or into the channel within the die. The puck may also be connected to the threaded rod, either removably or not and either rotatably or fixedly. A bottom cap which substantially resists compressed smokable material from coming out of the bottom of the device may be attached to the main body. The t-handle may be turned, translating the puck into and/or through the die. Smokable material may be compressed against the interior bottom surface of the bottom cap. The bottom cap may be removed and the t-handle may be turned further to push the compressed smokable material out of the device. The puck may fall out of the device, may be prevented from falling out of the device by being connected to the threaded rod, or may be prevented from falling out of the device by a retention feature in the die, such as a feature on the puck which is not matched by the channel for the entire length of the channel. The die may be pushed out of the device or it may be prevented from being pushed out of the device, such as due to a feature which interferes with the die translating out of the bottom of the body of the device.

In an alternate method, an alternate bottom cap may be attached after substantially compressing the smokable material, and then the t-handle may be turned further so as to push the compressed smokable material out through an opening in the alternate bottom cap while substantially resisting or preventing the die from being pushed out of the bottom cap. The opening may be sized and shaped so as to allow expulsion of the compressed material while resisting the die, or may be sized and shaped so as to allow the majority of the compressed smokable material to be pushed out while retaining a smaller portion within the bottom cap or die.

A spacer may be used to stop the motion of the puck when a desired height of compressed smokable material is reached. In one embodiment, the spacer may be connected to the top cap. In an alternate embodiment, the spacer may be attached to the t-handle. In another embodiment, the spacer may define an opening through which the threaded rod may pass. The spacer may be substantially ring-shaped, where the threaded rod is passed through the spacer prior to threading of the threaded rod into the top cap. The spacer may also have an opening in a side, allowing for the spacer to be slid onto the threaded rod even after the threaded rod has been threaded into the top cap. The spacer may have any other shape which may be functionally desirable or aesthetically pleasing.

Where the die is a separate component from the main body, the die may have a shorter length than that of the main body, may have a length equal to that of the main body, or may have a length longer than that of the main body. The die may also have a length which is longer than the length of the main body while being shorter than the combined length of the main body and the bottom cap. In such an embodiment, the die may extend through the entire internal height of the bottom cap, maintaining the form of the smokable material as it is being compressed against the bottom of the inside of the bottom cap. The die may also have a longer length than the length of the main body while having a shorter length than the combined length of the top cap, main body, and bottom cap.

In one embodiment, the device is configured such that the compressed smokable material substantially maintains the compressed size and shape after removal from the device. The smokable material, as a compressed packet, may be placed in a separate container, such as a soft pouch or bag, or within a rigid container. Through such a method, one or more compressed packets of smokable material may be stored or carried by a user without requiring the user to carry the device with them whenever they might wish to use a vaporizer. The device may be left behind, and compressed packets of smokable material may be taken and used with a vaporizer without requiring the carrying of additional devices, such as a tamp or funnel. In a preferred embodiment, the smokable material is compressed sufficiently that it substantially retains its size and shape while being stored or in typical conditions of carrying in a container.

In one embodiment of the invention, a kit including a puck, as described above, may be provided. A die may be provided, such that it conforms and interacts with the puck as described above. The kit may include a spacer, as described above. The kit may include a bottom cap with an opening configured to allow for expulsion of a compressed packet of smokable material from a press while resisting the passage of the puck. The kit may include a t-handle press. The kit may include any combination of the above components, either alone or with other components.

The disclosure relates to an improved device and method of forming smokable materials, such as through the use of the described invention. The method may include the use of a puck, a die, a spacer, a bottom cap, and/or a t-handle press or other type of press. Any number of components or features may be used in conjunction with the puck or die described, and various combinations, elements, or features may be used to achieve desired effects. Various materials, including metals, plastics, and composites, may be used for the described components and features.

It is to be understood that the above mentioned features and the features yet to be explained hereinafter can be used not only in the respectively mentioned combinations but also in other combinations or alone without departing from the spirit or context of the present invention.

BRIEF DESCRIPTION OF THE DRAWINGS

The invention is now disclosed in detail with reference to exemplary embodiments shown in the accompanying drawings, where.

DETAILED DESCRIPTION

Exemplary embodiments of the disclosure are illustrated in the Figures and are explained in the following description in more detail, wherein identical reference numbers refer to identical, or similar, or functionally identical or similar components.

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features or those previously described are omitted or simplified in order not to obscure the illustrative embodiments.

Various operations may be described as multiple discrete operations, in turn, in a manner that is most helpful in understanding the present invention, however the order of description should not be construed as to imply that these operations are necessarily order dependent. In particular, these operations need not be performed in the order of presentation.

Figure 1:
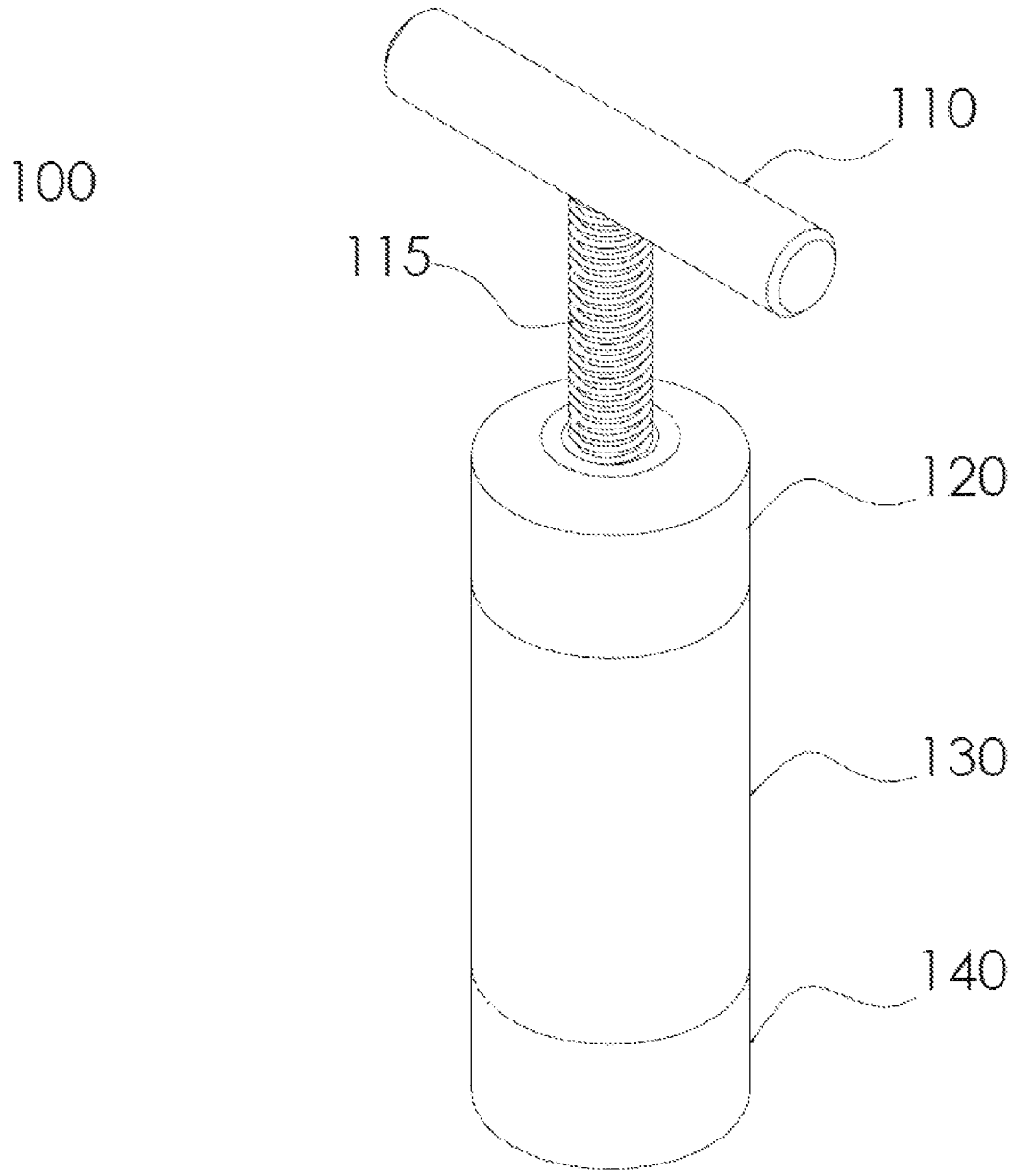
FIG. 1 shows a front top isometric view of an embodiment of the device of the present disclosure.

FIG. 1 shows a front top isometric view of an embodiment of the device 100. The device 100 includes a t-handle 110 which further includes a threaded rod 115. The t-handle 110 may thread into and through a top cap 120, which may be attached to a main body 130. The main body 130 may be attached to a bottom cap 140. It should be understood that other types of devices 100 may not utilize a t-handle 110, but may be actuated through other means. Additionally, other means of imparting mechanical advantage that do not require a threaded rod 115 may also be used, such as a lever arm. The top cap 120 and main body 130 may be unitary, though it may be preferable to have two distinct removably attachable components for easier use.

Figure 2:
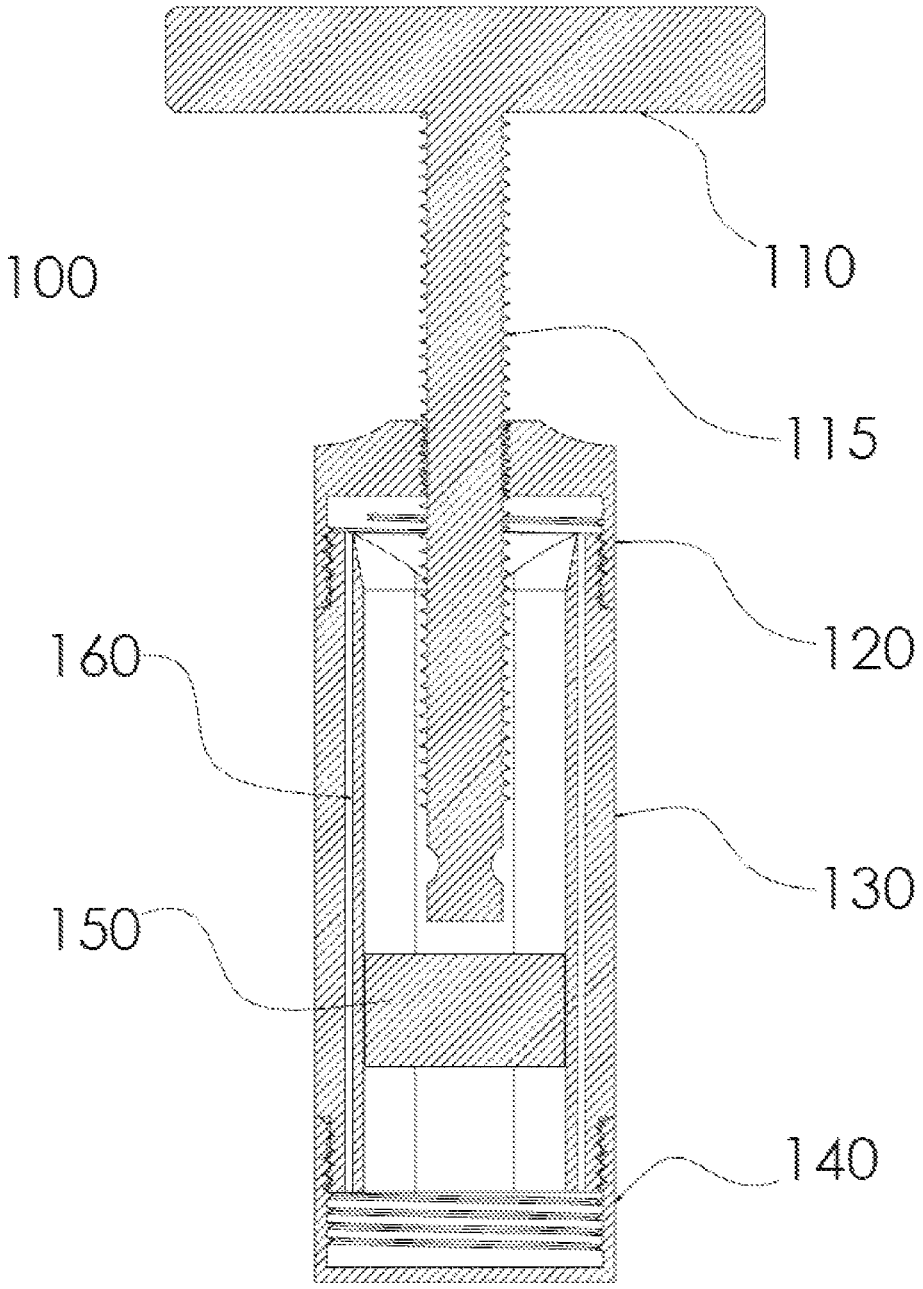
FIG. 2 shows a front sectional view of the embodiment of the device of FIG. 1.

A sectional view of the device 100 is shown in FIG. 2. The device 100 may include a puck 150 which may be translated through the device 100. The puck 150 is shown separate from the t-handle 110 in general and the threaded rod 115 in particular. It should, however, be understood that the puck 150 may be removably or permanently connected to the t-handle 110 or may be unitary with it. The puck 150 may also be fixedly or rotatably connected to the threaded rod 115.

A die 160 is shown substantially within the main body 130. While having the die 160 as a separate and removable component presents advantages, including allowing for the use of existing commercially available main bodies 130, it should be understood that the die 160 may be unitary with the main body 130. The die 160, as shown in FIG. 2, has substantially the same length as the main body 130, though other lengths, including both longer and shorter ones, may also be used.

Figure 3:
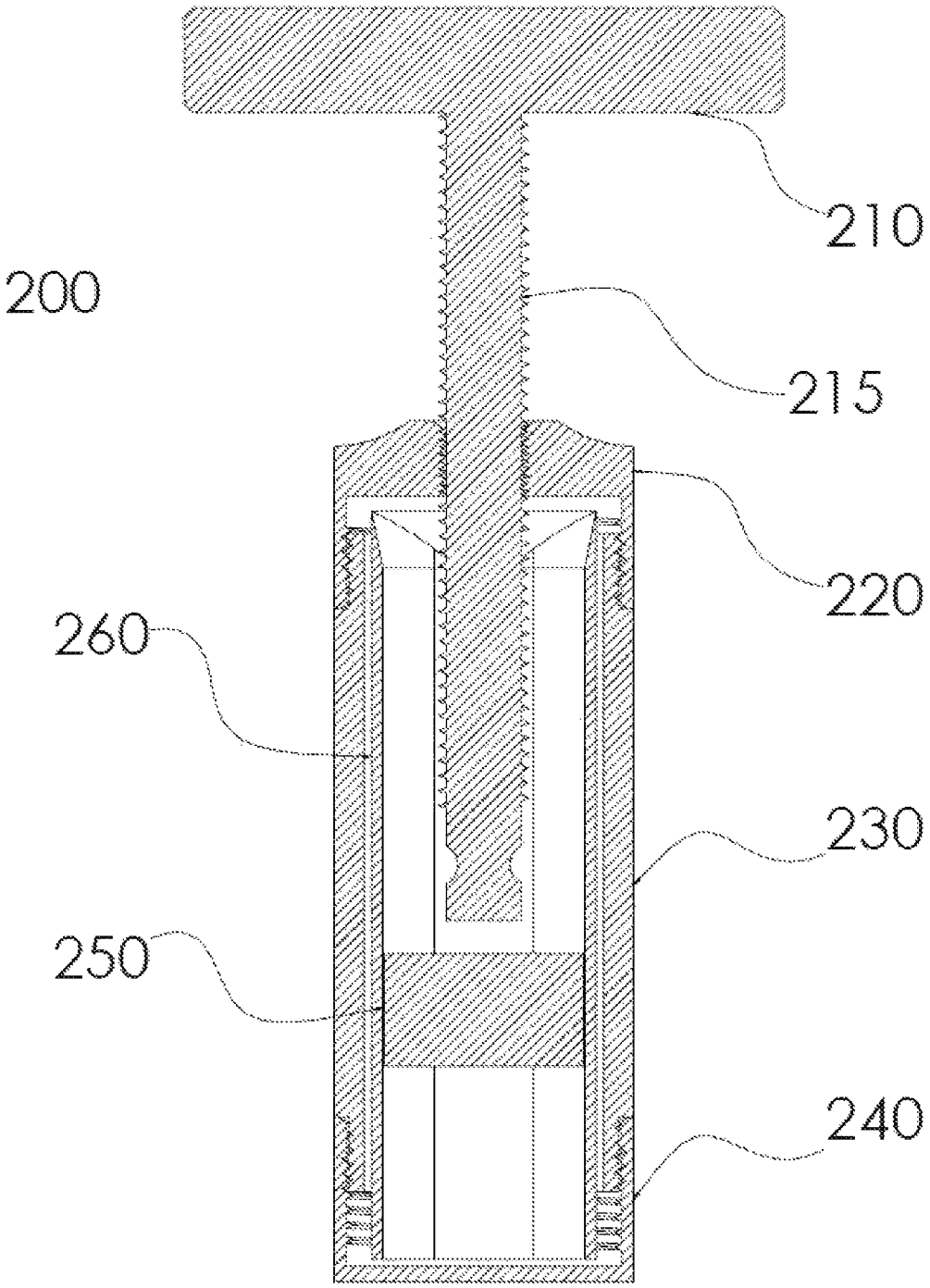
FIG. 3 shows a front sectional view of an alternate embodiment of the device of the present disclosure.

FIG. 3 shows a sectional view of an alternate embodiment of the device 200, where the die 260 has a longer length than that of the main body 230. In this embodiment, the die 260 is close to the same length as the combined length of the main body 230 and the bottom cap 240, though it is shorter than the combined length of the top cap 220, the main body 230, and the bottom cap 240.

Figure 4:
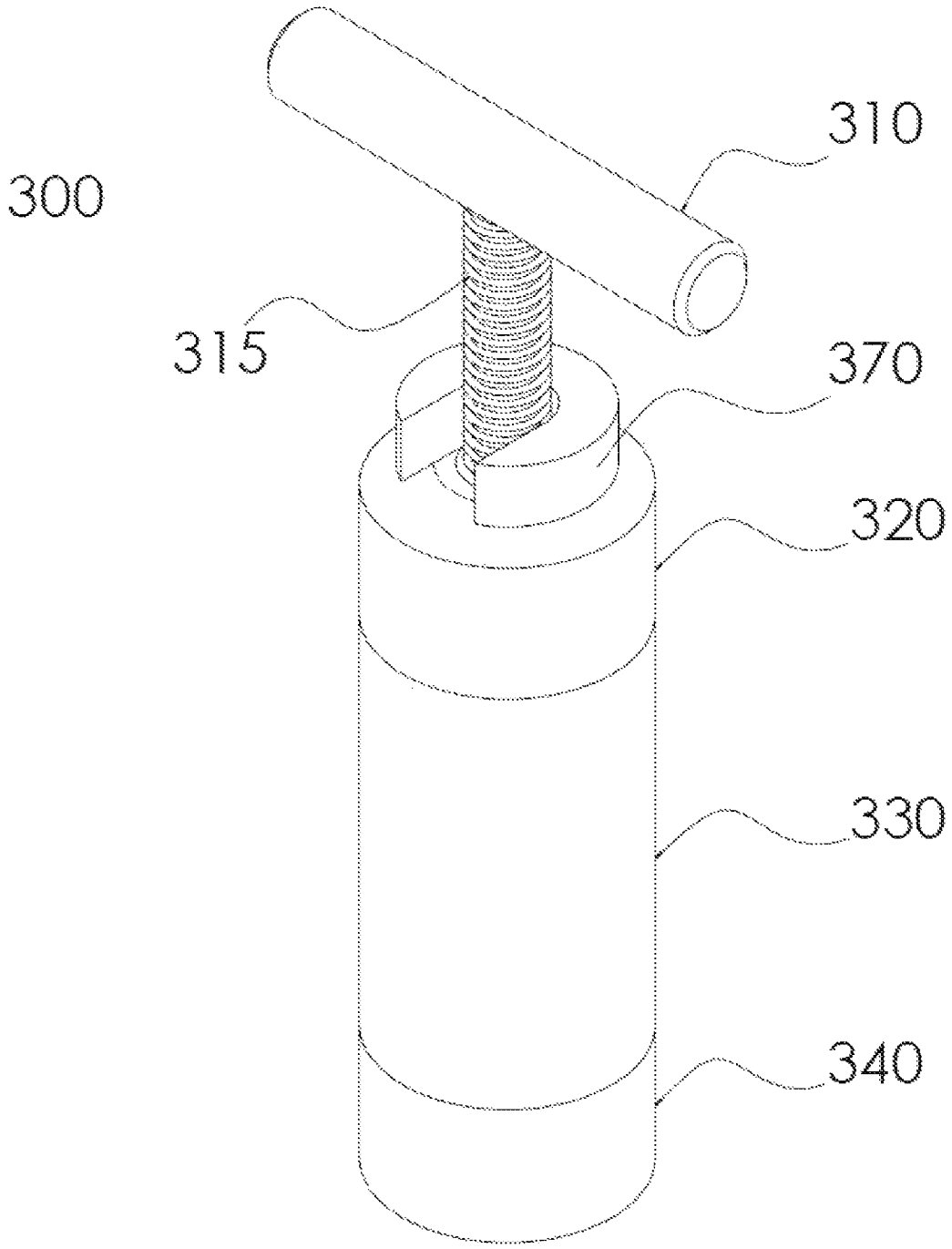
FIG. 4 shows a front top isometric view of an embodiment of the device of the present disclosure.
Figure 5:
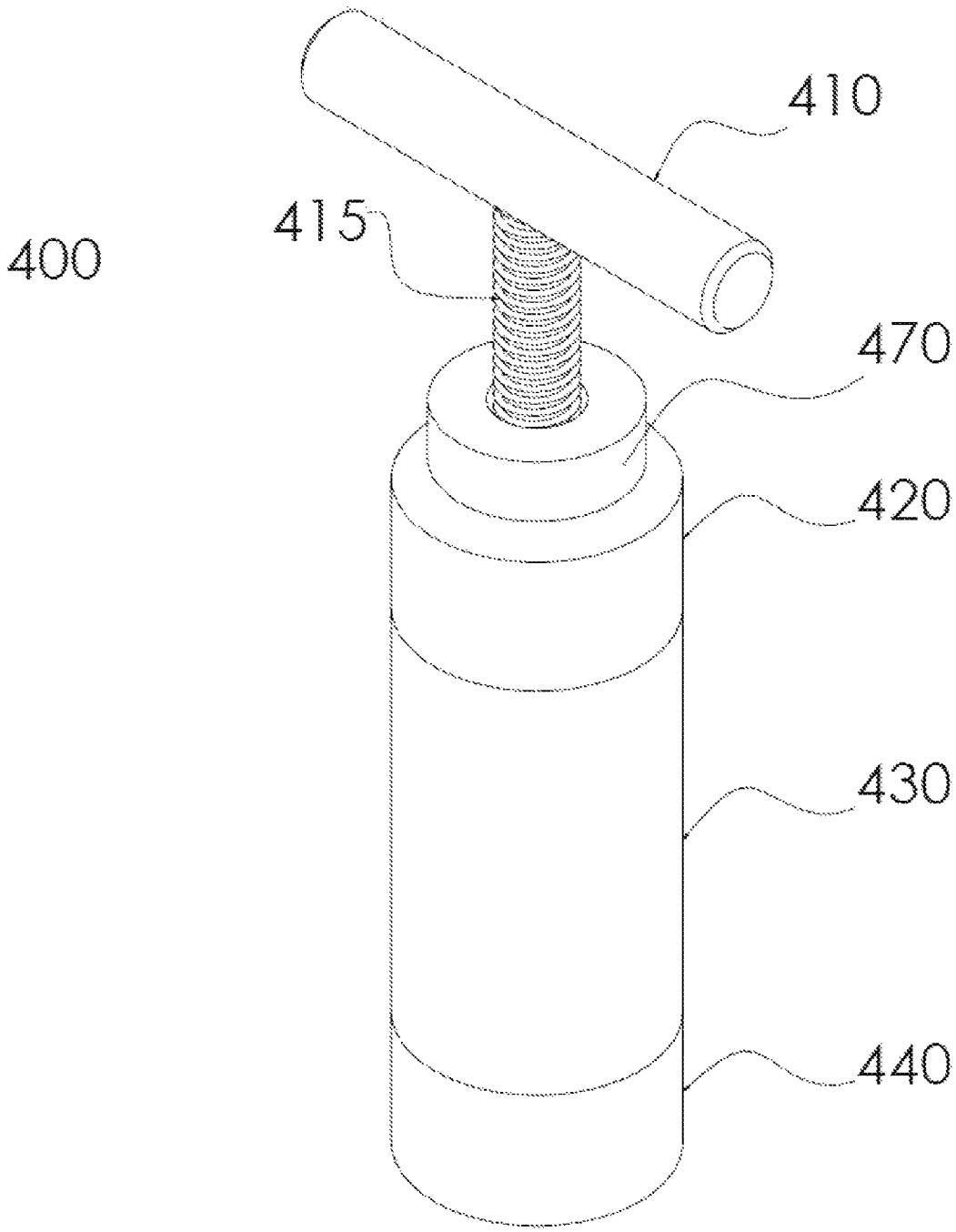
FIG. 5 shows a front top isometric view of another embodiment of the device of the present disclosure.

FIG. 4 shows a front top isometric view of another embodiment of the device 300. A spacer 370 is shown partially surrounding a portion of the length of the threaded rod 315. The spacer 370 limits the translation of the threaded rod 315 and the t-handle 310 when the threaded rod 315 is threaded through the top cap 320. Different heights of spacers may be used to create different amounts of compression of the smokable material. The spacer 370 is shown with an open configuration, such that it can be slid on or off of the threaded rod 315 without requiring separation of the threaded rod 315 from the top cap 320. FIG. 5 shows an alternate embodiment of the device 400 with an alternate spacer 470. This alternate spacer 470 may be permanently connected to top cap 420 or the t-handle 410. The alternate spacer 470 may be slidably connected to the threaded rod 415. The alternate spacer 470 may also be removable from the threaded rod 415, though it may require disconnecting the threaded rod 415 from the top cap 420.

Figure 6:
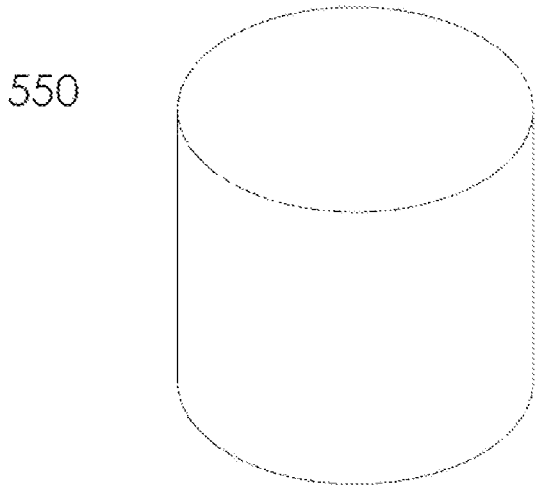
FIG. 6 shows a front top isometric view of an embodiment of the puck of the present disclosure.
Figure 7:
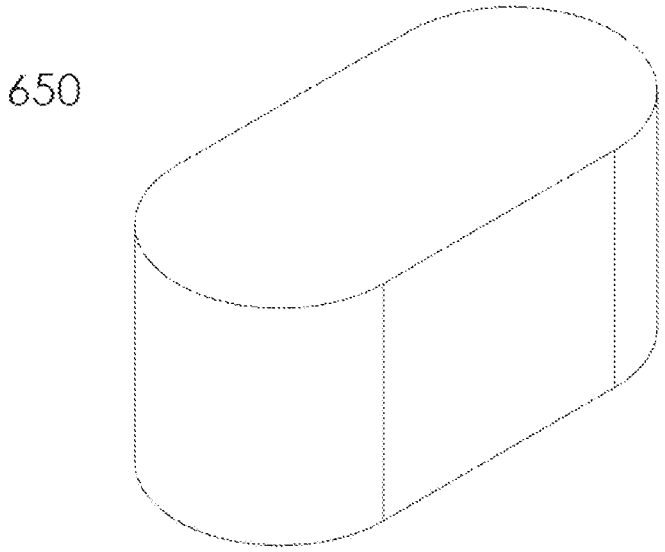
FIG. 7 shows a front top isometric view of an alternate embodiment of the puck of the present disclosure.

FIG. 6 shows a front top isometric view of an embodiment of the puck 550. The puck 550 has a footprint which is substantially circular, though other shapes of footprints may be desirable for compatibility with differed vaporizers or to allow for different air flow and gaps within the oven of a vaporizer. FIG. 7 shows an alternate puck 650 which has curved and linear features to its footprint.

Figure 8:
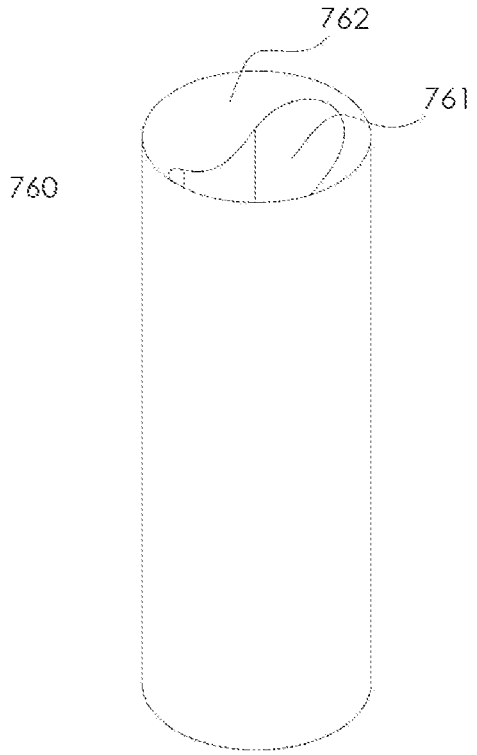
FIG. 8 shows a front top isometric view of an embodiment of the die of the present disclosure.
Figure 9:
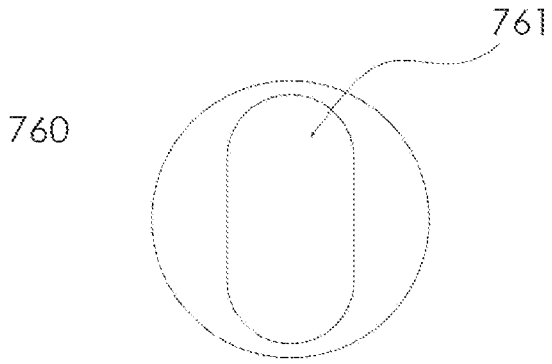
FIG. 9 shows a top view of the embodiment of the die of FIG. 8.

FIG. 8 shows a front top isometric view of an embodiment of the die 760, such as one that might be configured to be used with the puck 650 of FIG. 7. The die 760 may define a channel 761 which may pass through the length of the die 760. The die 760 may also feature a chamfered surface 762 on an end, enabling a user to fill or partially fill the channel 761 of the die 760 more easily or with less likelihood of spilling smokable material. FIG. 9 shows a top view of the die 760 of FIG. 8.

Figure 10:
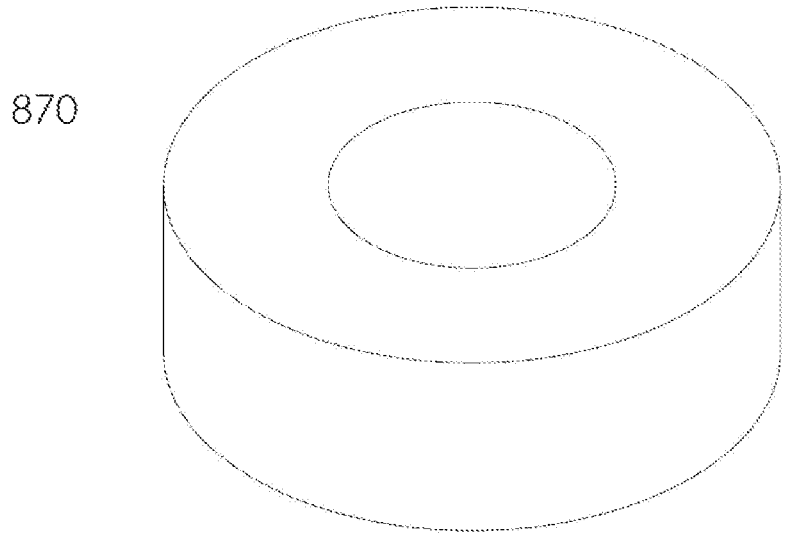
FIG. 10 shows a front top isometric view of an embodiment of the spacer of the present disclosure.
Figure 11:
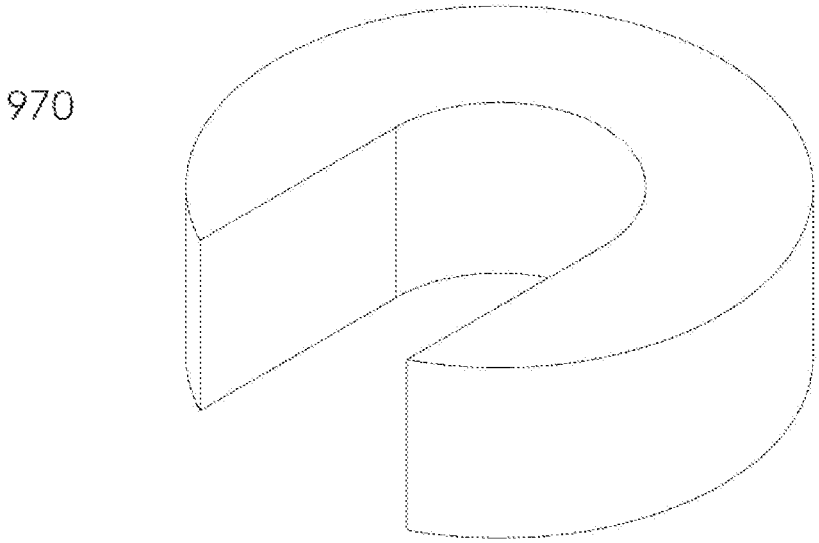
FIG. 11 shows a front top isometric view of an alternate embodiment of the spacer of the present disclosure.

FIG. 10 shows a front top isometric view of an embodiment of the spacer 870 of the present disclosure, with a closed configuration, which may require disassembly at least part of the device 400 to remove the spacer 870. FIG. 11 shows an alternate spacer 970, with an open configuration. The spacer 970 may be removed from the device 300 without requiring disassembly of the device 300.

Figure 12:
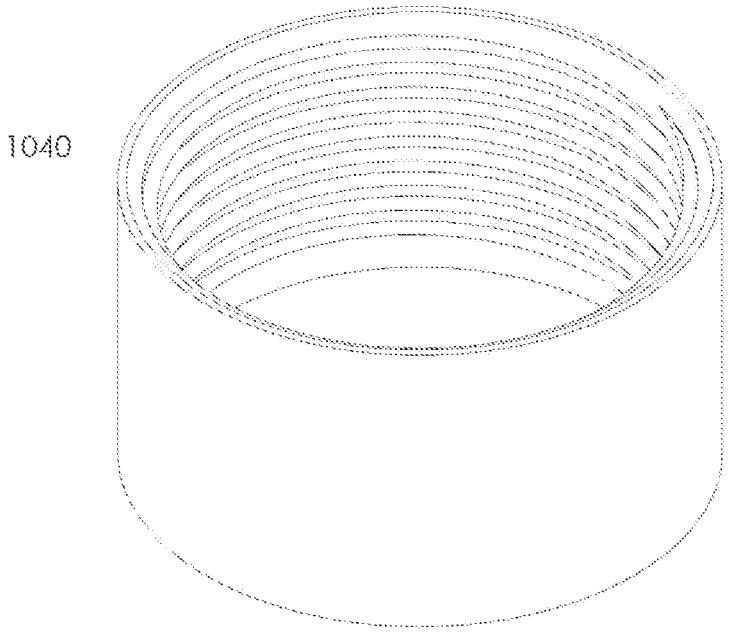
FIG. 12 shows a front top isometric view of an embodiment of the bottom cap of the present disclosure.
Figure 13:
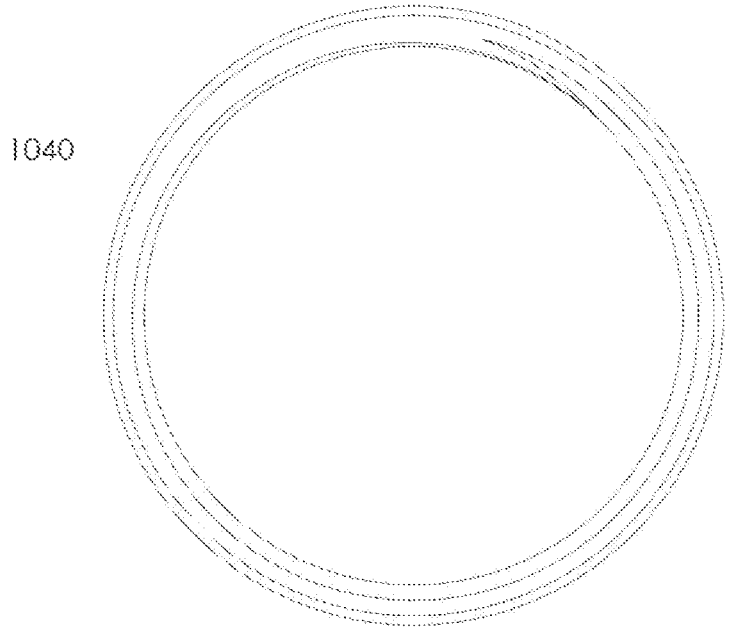
FIG. 13 shows a top view of the embodiment of the bottom cap of FIG. 12.
Figure 14:
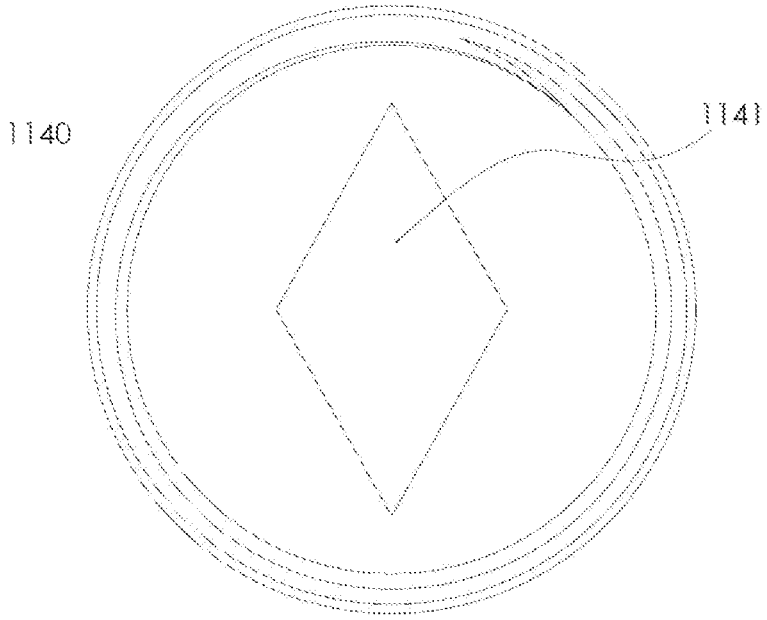
FIG. 14 shows a top view of an alternate embodiment of the bottom cap of the present disclosure.

FIG. 12 shows a front top isometric view of an embodiment of the bottom cap 1040. The bottom cap 1040 may substantially conform to the shape of the main body 130, or it may have a different footprint, such as hexagonal or octagonal, in order to more easily be attached to or removed from the main body 130. FIG. 13 shows a top view of the bottom cap 1040, wherein the bottom cap 1040 is substantially solid. FIG. 14 shows a top view of an alternate bottom cap 1140. The alternate bottom cap 1140 defines an opening 1141 which may be configured to allow passage of all or a substantial portion of a compressed packet of smokable material while resisting passage of a die 160.

Figure 15:
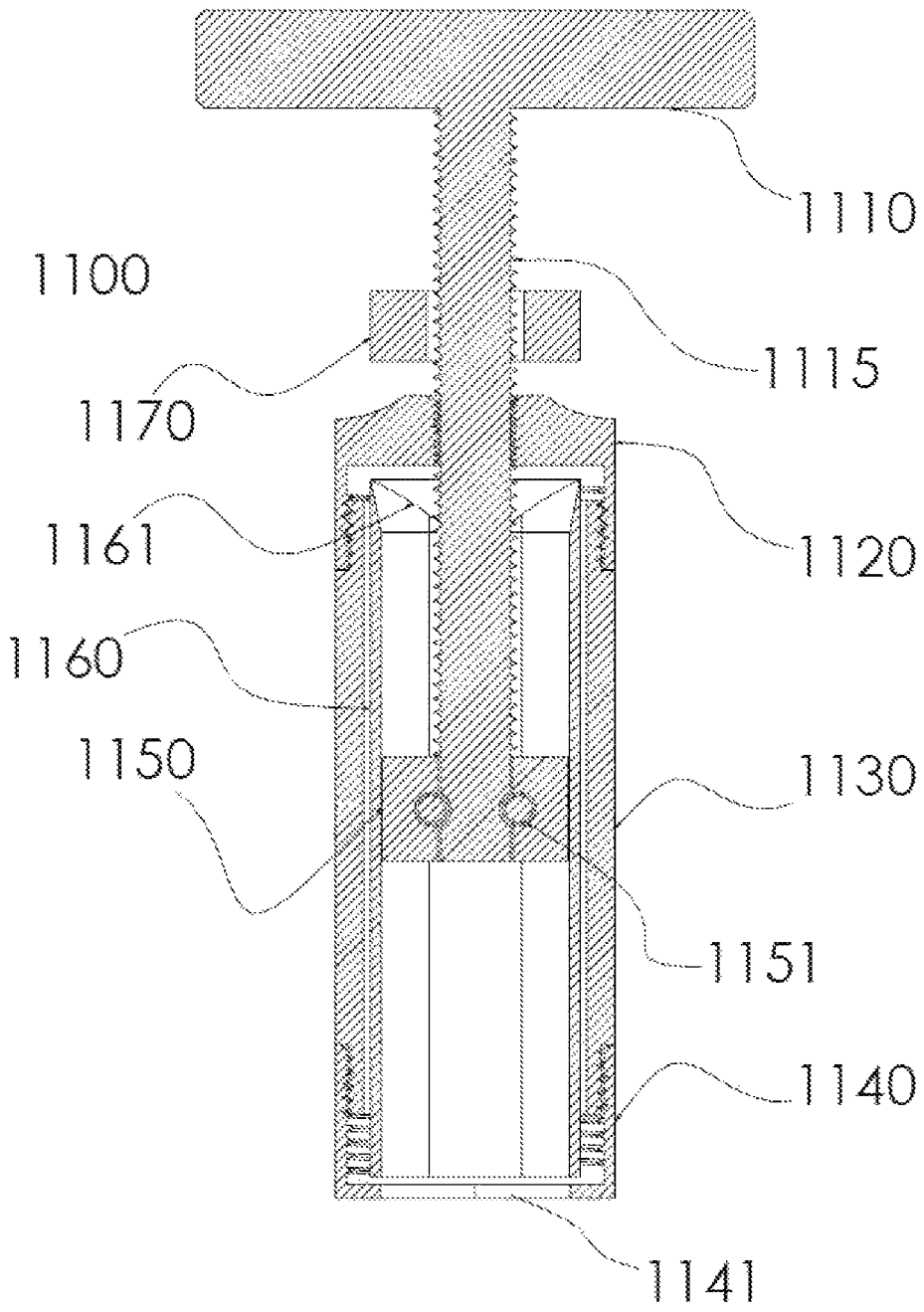
FIG. 15 shows a front sectional view of an alternate embodiment of the device of the present disclosure.

FIG. 15 shows a front section view of another embodiment of the present device 1100. The puck 1150 is connected to the threaded rod 1115. The puck 1150 may be connected by various means known in the art, such as pinning, welding, a press fit, or deformation. In the embodiment shown, the puck 1150 is connected to the threaded rod 1115 by means of one or more pins 1151. If a recess is provided along the circumference of the threaded rod 1115 which is sized equal to or larger than the pin 1151, and is off-axis from the axis passing through the threaded rod 1115, then the puck 1150 may be able to rotate around the threaded rod 1115 while translating along with it. The one or more pins 1151 may be removable, or may be attached to the puck 1150 or threaded rod 1115 by means of a press fit, welding, adhesive, deformation, or other means known in the art. In an embodiment where the puck 1150 is connected to the threaded rod 1115 but is not able to rotate around it, it may be preferable to have the die 1160 configured so as to be able to rotate relative to the main body 1130, thus allowing the die 1160 and the puck 1150 to remain in relative alignment. Where the puck 1150 is connected to the threaded rod 1115, it may be preferable to use an at least partially open spacer 1170 which can be slid off of the threaded rod 1115 without requiring disassembly of the device 1100.

An opening 1141 is defined by the bottom surface of the end cap 1140. In the embodiment shown, the opening 1141 is sized and shaped to allow for expulsion of compressed smokable material while not permitting the die 1160 to be passed out through the opening 1141. At least one chamfered surface 1161 is shown at the top end of the die 1160 in this embodiment, allowing for easier insertion of uncompressed smokable material into the die 1160.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention. Accordingly, various modifications, adaptations and alternatives may occur to one skilled in the art without departing from the spirit of the invention and scope of the claimed coverage.

What is claimed is:

1. A device for forming smokable material, comprising:

a puck with a bottom surface, a top surface, at least one side extending at least partially between the bottom surface and the top surface, and a first footprint corresponding to the bottom surface which has a first area;

a die which has a longitudinal axis extending substantially along a first length extending from a first top end of the die to a first bottom end of the die and wherein the die defines a first open volume, wherein the first open volume has a second footprint corresponding to a first cross-section of the first open volume substantially perpendicular to the longitudinal axis and defining a second area, the die has a first end proximal to the first top end defining a first opening, and the die has a second end proximal to the first bottom end defining a second opening; and a translating element;

wherein the first footprint of the puck is configured to substantially conform to a third footprint of a second cross-section of a second open volume defined by an oven of a vaporizer which is separate from the device for forming smokable material, the third footprint has a third area corresponding to the second cross-section, the first open volume is configured to substantially conform to and surround the at least one side of the puck, and the translating element is configured to translate the puck substantially along the longitudinal axis, and further wherein the die is removably insertable into the device.

2. The device according to claim 1, further wherein the device provides mechanical advantage when translating the puck along the longitudinal axis.

3. The device according to claim 2, further wherein the translating element is part of a press.

4. The device according to claim 3, further wherein the press is a t-handle press.

5. The device according to claim 4, further comprising a spacer which is configured to at least partially surround a translating feature of the t-handle press, wherein the spacer is further configured to impede the motion of the translating feature of the t-handle press when material which has been inserted into the die is compressed to a desired height.

6. The device according to claim 1, further wherein the first end of the die comprises at least one chamfered surface along a first edge between the first open volume and the top end.

7. A device for forming smokable material, comprising:

a puck with a bottom surface, a top surface, at least one side extending at least partially between the bottom surface and the top surface, and a first footprint corresponding to the bottom surface which has a first area;

a die which has a longitudinal axis extending substantially along a first length extending from a first top end of the die to a first bottom end of the die and wherein the die defines a first open volume, wherein the first open volume has a second footprint corresponding to a first cross-section of the first open volume substantially perpendicular to the longitudinal axis and defining a second area, the die has a first end proximal to the first top end defining a first opening, and the die has a second end proximal to the first bottom end defining a second opening; and a translating element;

wherein the first footprint of the puck is configured to substantially conform to a third footprint of a second cross-section of a second open volume defined by an oven of a vaporizer which is separate from the device for forming smokable material, the third footprint has a third area corresponding to the second cross-section, the first open volume is configured to substantially conform to and surround the at least one side of the puck, and the translating element is configured to translate the puck substantially along the longitudinal axis, further wherein the device provides mechanical advantage when translating the puck along the longitudinal axis, the translating element is part of a press, and further wherein the press comprises a body which has a second length, a second top end, and a second bottom end, and wherein the second length extends substantially from the second top end to the second bottom end and is less than the first length.

8. The device according to claim 3, further wherein the press comprises a body which has a second length, a second top end, and a second bottom end, and wherein the second length extends substantially from the second top end to the second bottom end, and a bottom cap which has a third length, a third top end and a third bottom end, and the third length extends substantially from the third top end to the third bottom end.

9. The device according to claim 8, further wherein the first length is less than the sum of the second length and the third length.

10. The device according to claim 3, further wherein the press comprises a first removable bottom cap which has a first substantially rigid bottom surface.

11. The device according to claim 10, further wherein the first removable bottom cap may be replaced by a second removable bottom cap which has a second bottom surface which defines a third opening having a fourth area at least equal to the first area.

12. The device according to claim 11, further wherein the device is configured to resist the translation of the die along the longitudinal axis through the third opening.

13. The device according to claim 1, further wherein the puck and the die are removable from the device.

14. The device according to claim 1, further wherein the device is configured to compress smoking material sufficiently wherein the smoking material may be removed from the device while substantially maintaining a compressed configuration.

15. The device according to claim 14, further wherein the compressed configuration has a fourth footprint corresponding to a fourth cross-section of the compressed configuration substantially perpendicular to the longitudinal axis and defining a fourth area, wherein the fourth area is smaller than the third area.

16. The device according to claim 1, further wherein the first footprint is substantially circular.

17. The device according to claim 1, further wherein the puck comprises at least one curved surface and at least one substantially planar surface.

18. A kit of parts adapted for use in forming smokable materials, comprising:

a puck with a bottom surface, a top surface, at least one side extending at least partially between the bottom surface and the top surface, and a first footprint corresponding to the bottom surface which has a first area and is configured to substantially conform to a second footprint corresponding to a first cross-section of a first open volume defined by an oven of a vaporizer, which is separate from the parts adapted for use in forming smokable materials; and a die which defines a longitudinal axis extending substantially along a first length from a first top of the die to a first bottom of the die, and a second open volume, wherein the second open volume has a third footprint corresponding to a second cross-section of the second open volume perpendicular to the longitudinal axis and further wherein the second open volume is configured to substantially conform to and surround the at least one side of the puck;

wherein the second footprint has a second area, the third footprint has a third area, and the first area is less than the second area, and further wherein the first footprint and the third footprint are both not circular.

19. The kit of parts according to claim 18, further comprising a t-handle press and a spacer component, wherein the t-handle press is a separate component from the die and the die may be inserted into the t-handle press.

* * * * *